US005653219A

United States Patent [19]

Taplan et al.

[11] Patent Number: 5,653,219

[45] Date of Patent: Aug. 5, 1997

[54] COOKING APPARATUS

[75] Inventors: Martin Taplan, Rheinböllen; Stefan Hubert, Bubenheim, both of Germany

[73] Assignee: Schott Glaswerke, Mainz, Germany

[21] Appl. No.: 604,011

[22] Filed: Feb. 20, 1996

[30] Foreign Application Priority Data

Feb. 17, 1995 [DE] Germany ..... 195 05 469.5

[51] Int. Cl.[6] ..... F24C 3/00

[52] U.S. Cl. ..... 126/39 H; 126/39 R

[58] Field of Search ..... 126/39 R, 39 H, 126/39 K

[56] References Cited

U.S. PATENT DOCUMENTS 5,046,477 9/1991 Bennett et al. ..... 126/39 H 5,429,114 7/1995 Taplal et al. ..... 126/39 H

*Primary Examiner*—Carroll B. Dority

*Attorney, Agent, or Firm*—Walter Ottesen

[57] ABSTRACT

A cooking apparatus includes at least one atmospheric gas burner and mutually adjacent first and second component assemblies. A frame holds the first and second component assemblies and the first component assembly includes a continuous glass-ceramic cook plate defining a planar surface and having a breakthrough formed therein for holding the gas burner in the cook plate. The cook plate has a boundary edge facing toward the second component assembly. The cook plate and the second component assembly conjointly define a gap therebetween at the boundary edge sufficiently wide to permit an adequate supply of primary air to pass from the ambient to below the cook plate and to the gas burner. A device is mounted in the gap for guiding the primary air into the gap. The device is attached seal-tight to at least one of the component assemblies and extends above the planar surface to prevent liquid on the planar surface from entering the frame through the gap.

13 Claims, 4 Drawing Sheets

COOKING APPARATUS

FIELD OF THE INVENTION

The invention relates to a cooking apparatus incorporating a device for guiding primary air to an atmospheric gas burner. The cooking apparatus includes a planar cook plate having a breakthrough in the area of the gas burner for accommodating the latter therein. The cook plate is made of glass ceramic and is held as a component assembly by means of a frame. The cooking apparatus includes at least one additional conventional component assembly.

BACKGROUND OF THE INVENTION

In floor mounted ranges, the primary air supply can be provided via venting slits in the range or in the area of the control elements. However, for built-in cooktops, an air supply from below via cutouts in the sheet metal base is often not possible because this would present significant limitations when mounting.

SUMMARY OF THE INVENTION

It is an object of the invention to provide a cooking apparatus incorporating a device for guiding primary air for an atmospheric gas burner. The device has an adequate surface for supplying air and can be integrated without difficulty into a built-in cooktop which does not permit supplying air especially from below through the base. The assembly of the device for guiding air is simple and is possible in a short time and at low cost both financially and with respect to materials used. The mounting for the air guide is achieved without special apparatus or a particular type of gas burner.

The cooking apparatus of the invention includes: at least one atmospheric gas burner; mutually adjacent first and second component assemblies; a frame for holding the first and second component assemblies therein; the first component assembly including a continuous glass-ceramic cook plate defining a planar surface and having a breakthrough formed therein for holding the gas burner therein; the cook plate having a boundary edge facing toward the second component assembly; the cook plate and the second component assembly conjointly defining a gap therebetween at the boundary edge sufficiently wide to permit an adequate supply of primary air to pass from the ambient to below the cook plate and to the gas burner; a device mounted in the gap for guiding the primary air into the gap; and, the device being attached seal-tight to at least one of the component assemblies and extending above the planar surface to prevent liquid on the planar surface from entering the frame through the gap.

Mounting the air-inlet guide between the glass-ceramic cook plate and a next-adjacent component assembly presents the following additional requirements:

(a) a seal-tight connection must be provided between the glass ceramic and the next-adjacent component assembly against the ingress of liquids such as overflowing food material;

(b) no mechanically rigid connection can be provided between the glass-ceramic cook plate and the air-inlet guide and the next-adjacent component assembly; and, (c) a minimum cross section for the entry of air must be provided which is matched to the gas burners used (for example, 700 $mm^2$/gas burner).

In a preferred embodiment of the invention, the component assembly mounted at a spacing and adjacent to the cook plate includes a mounting plate incorporating the switches and control elements for the cooking apparatus. The mounting plate is made of metal, glass ceramic or glass.

It has been shown to be advantageous when the mounting plate incorporating the switches and control elements is at an angle to the plane defined by the cook plate. The mounting plate and the control elements mounted therein are therefore at a slight incline toward the front of the cooking apparatus which provides a better view of the positions of the control elements to the user. Finally, the air-inlet guide can also be formed together with the frame when the component assembly adjacent the cook plate is part of the metal frame construction.

The air-inlet guide is seated with a precise fit in the gap between the cook plate and the adjacent component assembly. The precise fit can be achieved especially by means of appropriate spacers. The air-inlet guide is mounted on one side of the gap or on both sides of the gap or around the entire periphery of the gap. The air-inlet guide can be made of metal and the access to the opening defined by the gap is raised by means of the guide above the plane defined by the planar surface of the cook plate.

It is important that a certain volume of overflowing food material can be trapped without it reaching the inner space of the pan below the cook plate via the air-inlet guide and the gap. Otherwise, electric components and/or electronics mounted in the inner space of the pan below the cook plate could be damaged and dirtied by the overflow.

Cleaning materials in the form of liquids are used in the care and cleaning of the cook plate. It is also necessary to prevent such liquids from reaching the region below the cook plate via the air-inlet guide and the gap. Accordingly, it is advantageous to increase access to the gap by appropriate barrier means extending approximately 3 to 5 mm above the surface of the cook plate.

In addition, the air-inlet guide can be bent over to one side in a hood-like manner to overlap the opening at a spacing above the gap. This prevents or reduces the entry of dirt and dust from above and imparts an attractive appearance to the cooktop.

According to another feature of the invention, the air-inlet device can include a slotted or perforated outer tube mounted in the gap between the cook plate and the adjacent component assembly. An inner tube is rotatably journalled in the outer tube so that the inner tube can be rotated relative to the outer tube. The inner tube too is provided with openings which can, for example, have the form of slots.

With this last-mentioned embodiment of the air-inlet device, the quantity of air to be supplied to the gas burner and the direction of air induction can be controlled and adjusted. The inner tube can be rotated between a first position wherein the outer and inner openings of the respective tubes are aligned thereby permitting a maximum amount of air flow to the gas burner and a second position wherein the outer and inner openings are completely unaligned thereby completely blocking the entry of air. In this second position, the operator can clean the glass-ceramic cooktop with a liquid cleaning medium and the latter will be prevented from flowing, through the gap. The air supply can be adjusted by positioning the inner tube between the first and second positions wherein the outer and inner openings partially overlap.

It has been shown to be especially advantageous to mount the air-inlet guide by means of a silicone adhesive which provides a seal-tight and an elastic interface between air-inlet guide and the cook plate and/or the adjacent component assembly.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
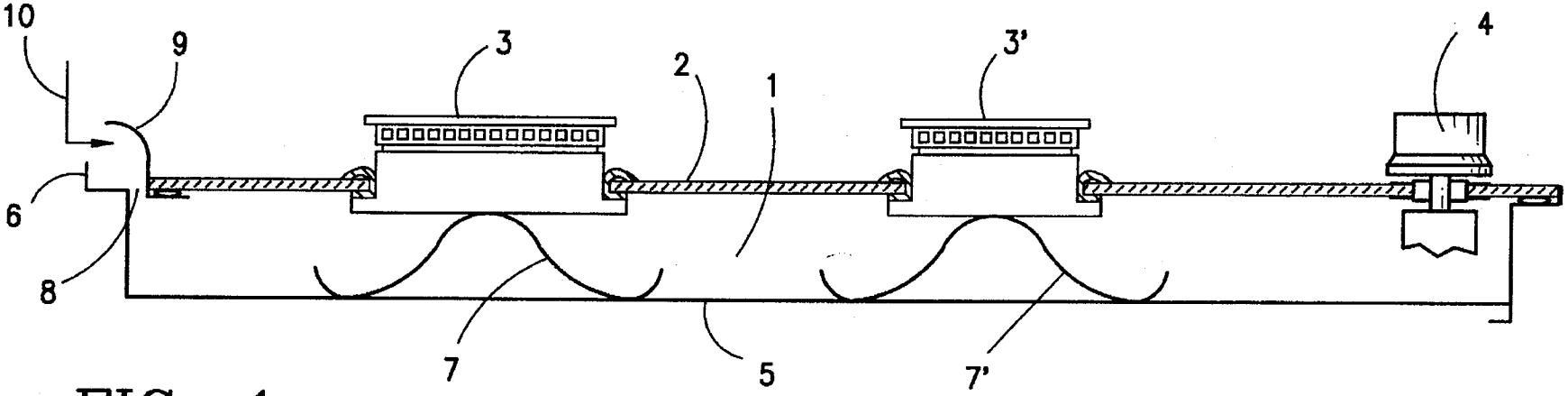
FIG. 1 is a side elevation schematic of the cooking apparatus of the invention wherein the air-inlet guide is disposed between the frame made of sheet metal and the cook plate made of glass ceramic.

FIG. 1 shows a drop-in cooktop 1 having a pan-shaped base 5 made of sheet metal, a continuous planar glass-ceramic cook plate 2 having two atmospheric gas burners (3, 3') mounted therein. The cook plate 2 has breakthroughs in the region of the gas burners wherein the gas burners are mounted. The gas burners (3, 3') are supported on the sheet metal base 5 by means of elements (7, 7') made of resilient sheet metal.

In the embodiment of FIG. 1, the primary air supply (arrow 10) enters between the frame 6 and the glass-ceramic cook plate 2. An air-inlet device 9 made of high-grade steel or black-enameled or anodized metal protects the opening 8 against the ingress of liquids in the form of overflowing food material or a liquid cleaning medium. The air-inlet device 9 has a hood-like shape and is at a spacing above the opening or gap 8 between the cook plate 2 and the frame 6.

FIGS. 2 to 5 show other embodiments of the invention wherein the air-inlet device is mounted in a gap between the cook plate and a mounting plate for the control elements of the cooking apparatus.

Figure 2:
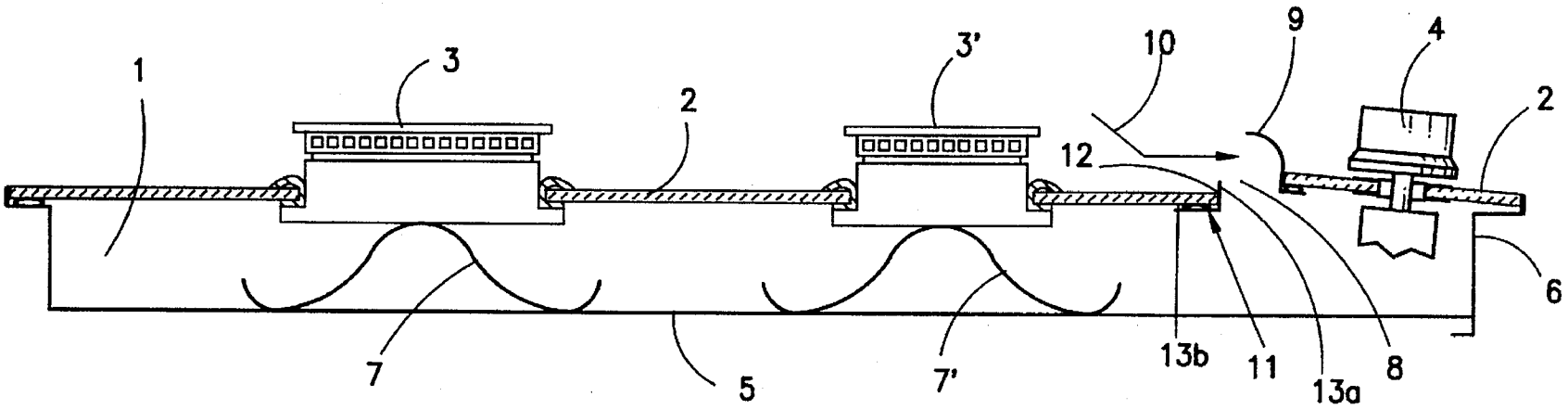
FIG. 2 is a schematic of a cooking apparatus wherein the air-inlet guide is mounted between a glass-ceramic cook plate and a glass-ceramic mounting plate for the control elements of the cooking apparatus with the mounting plate being inclined at an angle.
Figure 3:
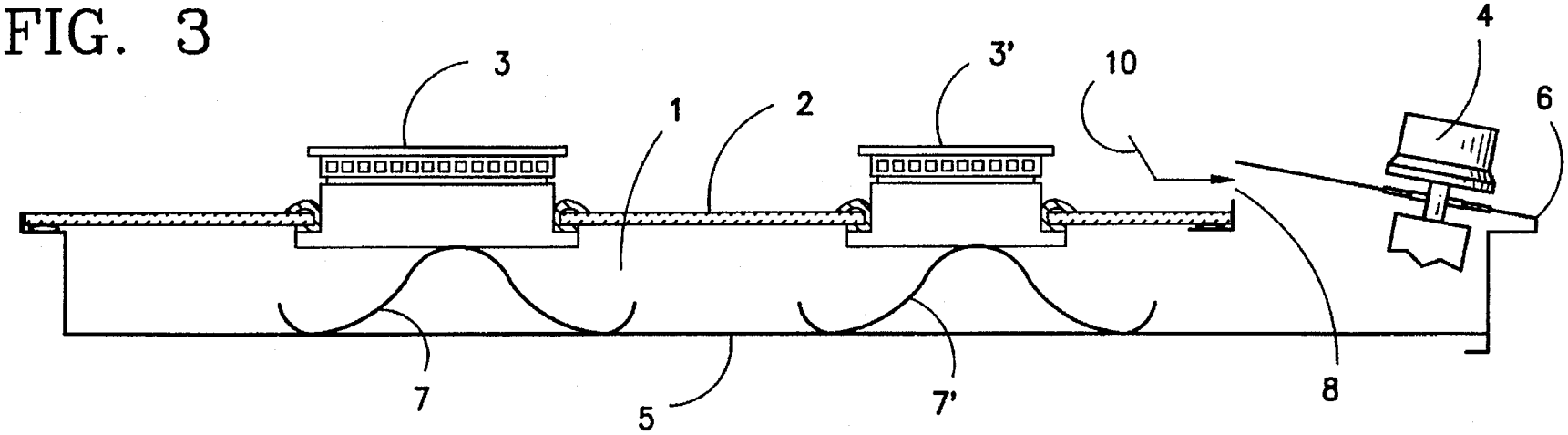
FIG. 3 is another embodiment of the cooking apparatus of the invention wherein the air-inlet guide is mounted between the glass-ceramic cook plate and a control-element mounting plate made of sheet metal with the mounting plate likewise being inclined at an angle.
Figure 4:
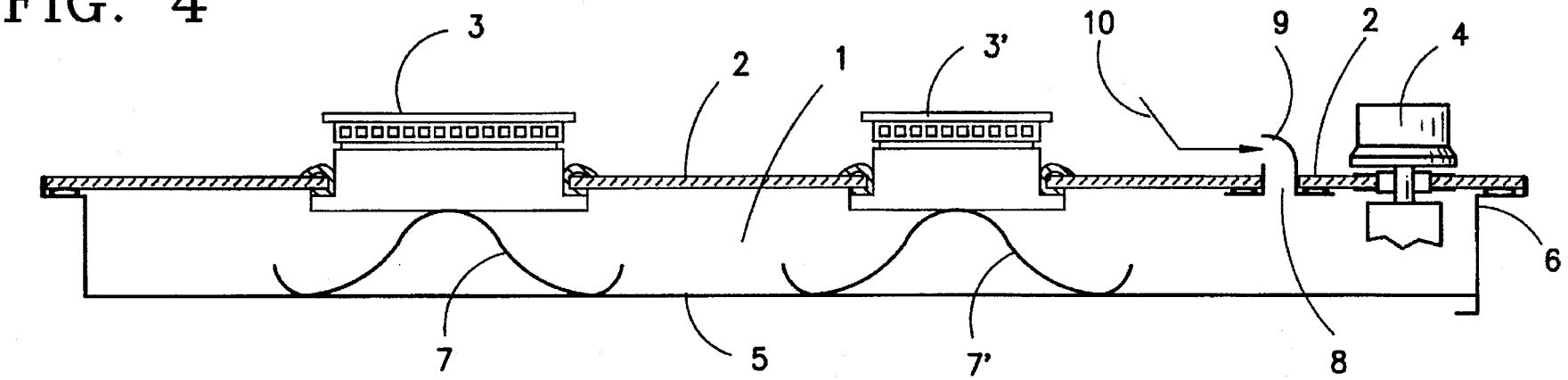
FIG. 4 is another embodiment of the cooking apparatus of the invention wherein the air-inlet guide is mounted between the glass-ceramic cook plate and a glass-ceramic mounting plate for holding the control elements with the mounting plate being arranged in the plane of the cook plate.
Figure 5:
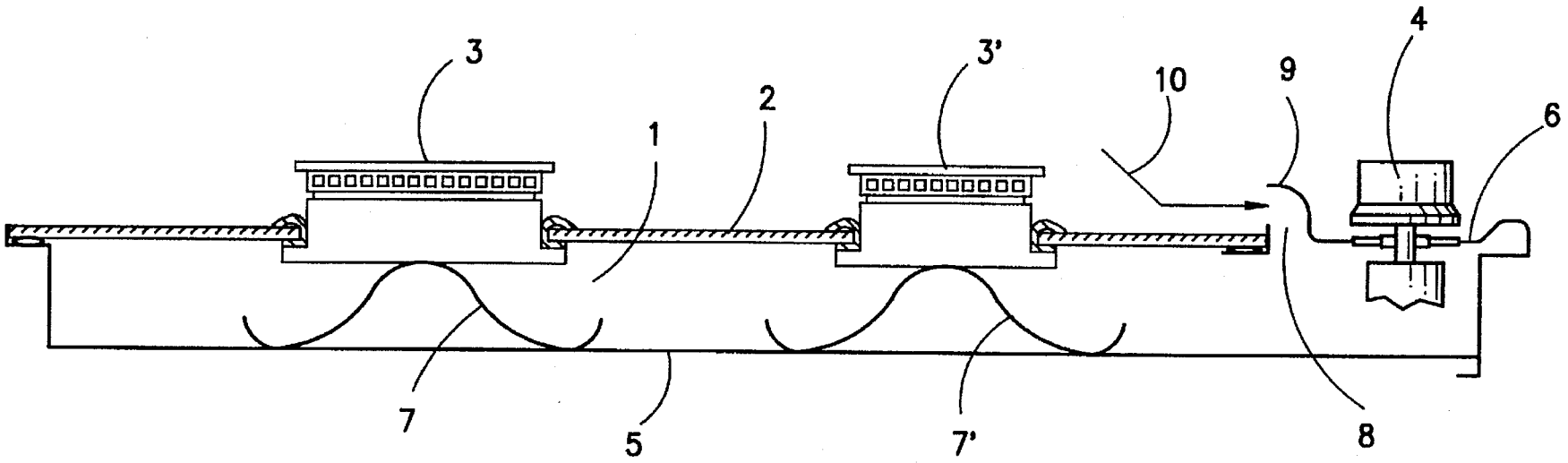
FIG. 5 is an embodiment of the cooking apparatus of the invention wherein the air-inlet guide is mounted between the glass-ceramic cookplate and the mounting plate for the control elements which is made of sheet metal with the mounting plate being arranged in the plane of the cook plate; and, FIGS. 6*a* to 6*c* are detail views of an air-inlet device which can be adjusted to set the flow of primary air supplied to the gas burners.

Referring to FIG. 2, an angle section 11 is provided at the boundary edge 12 of the cook plate 2. One leg 13*a* of the angle section extends upwardly beyond the top surface of the cook plate 2 to prevent overflowing food material from entering the gap 8. The other leg 13*b* of the angle section 11 and the cook plate 2 conjointly define an interface 14 at which a silicone adhesive is provided. Accordingly, the connection of the metal angle section 11 to the glass-ceramic cook plate 2 is not so rigid so that the cook plate would be protected against breakage when the metal angle is subjected to stress. The connection provided by the silicone adhesive is firm but yet somewhat elastic to protect the glass-ceramic cook plate 2.

Figure 6A:
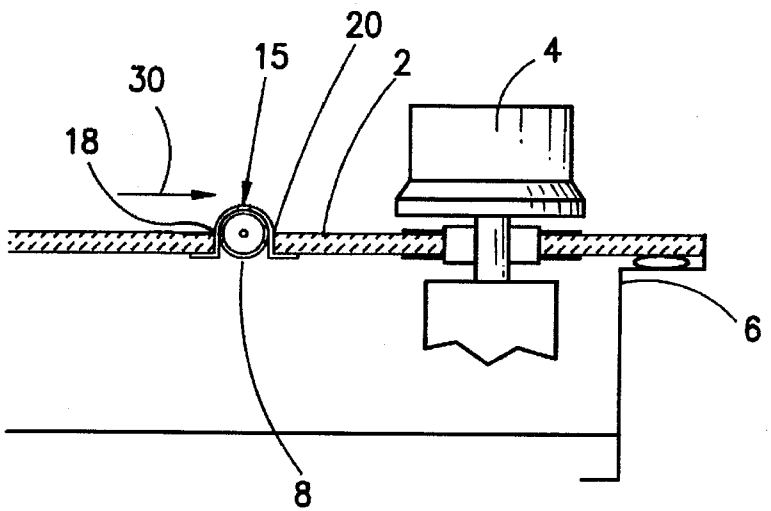
Figure 6C:
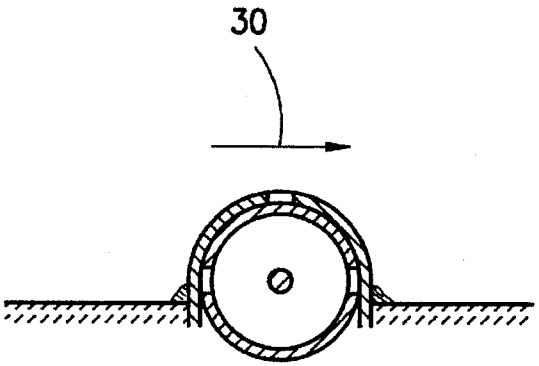
Figure 6B:
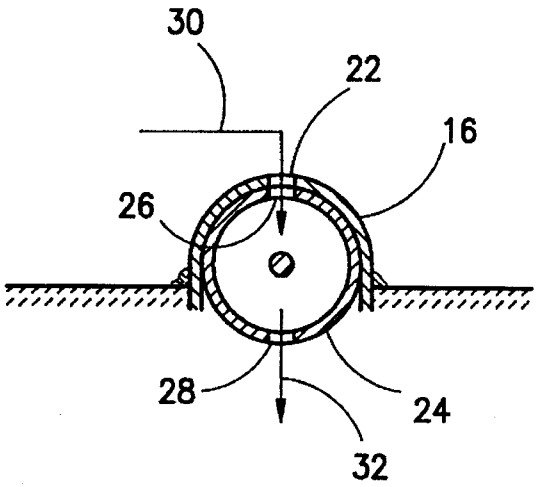

FIGS. 6*a* to 6*c* show an embodiment of the cooking apparatus of the invention wherein the flow of primary air to the gas burner can be adjusted. The air-inlet device is identified by reference numeral 15 and includes an outer tube or curved channel 16 seated in the gap between boundary edges 18 and 20. The outer tube 16 has a lateral outer opening 22 formed therein.

The inner tube 24 is rotatably journalled in the outer tube 16 so as to be rotatable between a first position (shown in FIG. 6*b*) wherein the outer and inner openings overlap so as to permit the primary air to flow (arrows 30 and 32) from the ambient through the outer and inner openings and into the frame and to the gas burner and a second position (shown in FIG. 6*c*) wherein the outer and inner openings are completely unaligned so that the primary air cannot pass therethrough.

The inner tube can be set between the first and second positions so that the inner opening 26 partially overlaps with outer opening 22 thereby adjusting the amount of primary air flowing to the gas burner.

It is understood that the foregoing description is that of the preferred embodiments of the invention and that various changes and modifications may be made thereto without departing from the spirit and scope of the invention as defined in the appended claims.

What is claimed is:

1. A cooking apparatus comprising:

at least one atmospheric gas burner;

mutually adjacent first and second component assemblies;

a frame for holding said first and second component assemblies therein;

said first component assembly including a continuous glass-ceramic cook plate defining a planar surface and having a breakthrough formed therein for holding said gas burner therein;

said cook plate having a boundary edge facing toward said second component assembly;

said cook plate and said second component assembly conjointly defining a gap therebetween at said boundary edge sufficiently wide to permit an adequate supply of primary air to pass from the ambient to below said cook plate and to said gas burner;

a device mounted in said gap for guiding said primary air into said gap; and, said device being attached seal-tight to at least one of said component assemblies and extending above said planar surface to prevent liquid on said planar surface from entering said frame through said gap.

2. The cooking apparatus of claim 1, a portion of said device and at least one of said component assemblies conjointly defining an interface; and, said cooking apparatus further comprising a silicone adhesive at said interface for elastically and seal-tight attaching said device to said at least one of said component assemblies.

3. The cooking apparatus of claim 2, said second component assembly including a mounting plate and a plurality of control elements for said cooking apparatus mounted in said mounting plate.

4. The cooking apparatus of claim 3, said mounting plate being made of metal.

5. The cooking apparatus of claim 3, said mounting plate being made of glass ceramic or glass.

6. The cooking apparatus of claim 3, said mounting plate being mounted at an angle relative to the plane defined by said planar surface of said cook plate.

7. The cooking apparatus of claim 3, said frame being made of metal; and, said second component assembly incorporating said metal frame.

8. The cooking apparatus of claim 1, said boundary edge of said cook plate being a first boundary edge; and said second component assembly defining a second boundary edge opposite said first boundary edge so that said first and second boundary edges are on mutually opposite sides of said gap; said device being dimensioned to precisely fit into said gap so as to be seated at at least one of said edges; and, said device being made of metal and extending above the plane defined by said planar surface so as to define an inlet to said gap which extends above said plane.

9. The cooking apparatus of claim 8, said device being configured to have a hood-like shape overlapping said gap at a spacing thereabove to facilitate the flow of said primary air to said gap.

10. The cooking apparatus of claim 1, said boundary edge of said cook plate being a first boundary edge and said second component assembly defining a second boundary edge opposite said first boundary edge; and, said device including an outer tube seated in said gap between said first and second boundary edges; said outer tube having lateral outer openings formed therein; and, an inner tube having lateral inner openings formed therein; and, said inner tube being rotatably journalled in said outer tube so as to be rotatable between a first position wherein said outer and inner openings overlap so as to permit said primary air to pass from the ambient through said outer and inner openings and into said frame and to said gas burner and a second position wherein said outer and inner openings are completely unaligned so that said primary air cannot pass therethrough.

11. The cooking apparatus of claim 10, said inner tube being positionable between said first and second positions so that said outer and inner openings partially overlap thereby regulating the flow of said primary air to said gas burner.

12. A cooking apparatus comprising:

at least one atmospheric gas burner;

a component assembly;

a frame for holding said component assembly therein and defining a first boundary edge;

said component assembly including a continuous glass-ceramic cook plate defining a planar surface and having a breakthrough formed therein for holding said gas burner therein;

said cook plate having a second boundary edge facing toward said first boundary edge;

said cook plate and said frame conjointly defining a gap between said first and second boundary edges sufficiently wide to permit an adequate supply of primary air to pass from the ambient to below said cook plate and to said gas burner;

a device mounted in said gap for guiding said primary air into said gap; and, said device being attached seal-tight to at least one of said frame and said component assembly and extending above said planar surface to prevent liquid on said planar surface from entering said frame through said gap.

13. The cooking apparatus of claim 12, a portion of said device and at least one of said frame and said component assembly conjointly defining an interface; and, said cooking apparatus further comprising a silicone adhesive at said interface for holding said device to said at least one of said frame and said component assembly.

* * * * *